US005553340A

United States Patent [19]

Brown, Jr.

[11] Patent Number: 5,553,340

[45] Date of Patent: Sep. 10, 1996

[54] UTILITY TOOL FOR POWER CHAIN SAW

[76] Inventor: James D. Brown, Jr., 6 Donnan Rd., Taylors, S.C. 29687

[21] Appl. No.: 344,895

[22] Filed: Nov. 25, 1994

[51] Int. Cl.[6] ..... B26B 11/00

[52] U.S. Cl. ..... 7/118; 81/440; 81/177.4; 81/177.6; 81/490; 7/120; 7/138; 7/165

[58] Field of Search ..... 7/100, 118, 120, 7/138, 165; 81/177.4, 177.6, 440, 490

[56] References Cited

U.S. PATENT DOCUMENTS

| | | | |
|---|---|---|---|
| 4,187,607 | 2/1980 | Simuro et al. . | |
| 4,238,862 | 12/1980 | Leatherman . | |
| 4,442,559 | 4/1984 | Collins . | |
| 4,648,145 | 3/1987 | Miceli . | |
| 4,836,066 | 6/1989 | Graham et al. | 87/177.4 |
| 5,220,706 | 6/1993 | Bivens . | |

*Primary Examiner*—James G. Smith

*Attorney, Agent, or Firm*—Dority & Manning

[57] ABSTRACT

A power chain saw utility tool provides an apparatus for effecting mechanical repairs and/or adjustments to a power chain saw having a chain bar. In one presently preferred embodiment, the power chain saw utility tool comprises a first elongated cylindrical case member that defines an elongated interior compartment having a transverse cross section with a non-circular shape into which a slide member is received. The slide member in this embodiment includes a plurality of interleaved members pivotally attached at one end thereof and comprising tools adaptable for making minor repairs and/or adjustments to the power chain saw. The slide member is selectively pivotable about the open end of the elongated cylindrical case member. When fully retracted, however, the slide member is received entirely within the elongated cylindrical case member. The elongated cylindrical case member, furthermore, has a closed end opposite to the open end, said closed end comprising a socket configured with a shape to receive, for example, a nut that secures the housing assembly of the chain bar of the power chain saw.

19 Claims, 4 Drawing Sheets

UTILITY TOOL FOR POWER CHAIN SAW

BACKGROUND OF THE INVENTION

The present invention relates to a hand tool and more particularly to a utility tool for a power chain saw.

Normal operation of a gasoline powered chain saw results in numerous problems requiring minor adjustments and repairs. For example, the spark plug may need to be removed and the gap reset. Carbon deposits accumulating on the point of the spark plug may need to be filed off. The idle adjustment screw on the carburetor may need to be adjusted. The chain may need to be tightened by adjusting the chain bar. The oil hole on the chain bar may become clogged. The nuts holding the chain bar become loosened and need to be tightened. The blades on the chain may need to be sharpened. The oil groove near the edge of the chain bar may need to be cleaned. Moreover, each of these problems requires different tools to effect the appropriate adjustments and repairs. Thus, a half dozen or more tools might be necessary.

Gasoline powered chain saws are often used in remote areas without access to facilities for making minor adjustments and repairing minor faults in the saw. Furthermore, the operator of the saw might be using the saw in a location that is inconvenient for storing the necessary tools as well as inconvenient for using the tools. For example, the saw operator might be situated in a bucket elevated above the ground or be in a wooded area remote from the operator's vehicle.

OBJECTS AND SUMMARY OF THE INVENTION

It is a principal object of the present invention to provide a portable hand-held device for making numerous on-site recurring repairs and/or adjustments to a powered chain saw.

It is another principal object of the present invention to provide a device that can be unobtrusively yet conveniently carried on the person of an operator of a powered chain saw and capable of assisting the operator to make numerous minor repairs and/or adjustments to the chain saw.

It is a further principal object of the present invention to provide a portable, hand-held, utility tool for power chain saws wherein the tool can be stored unobtrusively yet conveniently on the person of the operator and includes a plurality of selectively deployable individual tools, each tool useful for at least one repair job or adjustment job that is typical of a power chain saw.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an apparatus for effecting mechanical repairs and/or adjustments to a power chain saw having a chain bar secured by a fastener comprises a first elongated member including a plurality of interleaved members wherein at least one interleaved member is pivotally attached at one end thereof to said elongated member and is configured in the form of a tool configured for making repairs and/or adjustments to the power chain saw, said tool being selectively pivotable about said one end for selectively deploying said tool in an operational mode; and a second elongated member having a closed end disposed on one side thereof, said closed end defining a socket configured with a shape to receive a fastener on the power chain saw, said second elongated member being operatively connected to said first elongated member such that said first elongated member may be operatively disposed at an angle less than 180 degrees with respect to said second elongated member, whereby a force perpendicularly applied to said first elongated member creates a torque at said socket.

In one presently preferred embodiment of the present invention, a plurality of said interleaved members is pivotally attached at said one end of said elongated member and comprises an implement, such as a flat head screwdriver having a blade of a size appropriate to fit the adjustment mechanism, such as an adjustment screw, used to adjust the tension on the chain bar of the power chain saw; a torques driver of a size appropriate for making adjustments to the torques screws used in assembling the power chain saw; a knife blade having a cutting edge along one lateral edge and a blunt edge along the opposite lateral edge; a wire tool including a wire that can be used for cleaning oil from the oil hole on the chain bar of the power chain saw and/or for cleaning hard-to-reach crevices of a fouled spark plug, a file for cleaning the spark plug point of the spark plug employed in the power chain saw, and wherein the smooth or blunt edge of the back of the file is of a thickness sized to the desired spark plug gap of the spark plug employed in the power chain saw; and an elongated cleaning tool having a scooped end of a size and configuration appropriate for cleaning the chain bar groove of the power chain saw.

In yet another presently preferred embodiment of the invention, the apparatus for effecting mechanical repairs and/or adjustments to a power chain saw having a chain bar secured by a fastener comprises an elongated cylindrical case member defining an elongated interior compartment having a transverse cross-section with a non-circular shape; said case member having a closed first end and a second end disposed opposite to the closed end; the first end of the case member defining a socket configured with a shape to receive a fastener, such as a nut or the head of a threaded bolt, that secures the housing assembly of the chain bar of the power chain saw; a slide member that includes a plurality of interleaved members wherein at least one interleaved member is pivotally attached at one end thereof to the slide member and is configured in the form of a tool adaptable for making repairs and/or adjustments to the power chain saw, the tool being selectively pivotable about the one end for selectively deploying the tool in an operational mode, the slide member having a transverse exterior cross-sectional shape configured such that the slide member may be selectively telescopically received within the non-circular elongated interior compartment defined within the case member, and a retaining member configured to engage the slide member when the slide member is maximally extracted from the case member so that the slide member may be selectively disposed at an angle less than 180 degrees with respect to the case member, whereby a force perpendicularly applied to the slide member creates a torque at the socket. In this way the operator may use the slide member as a lever to manually apply a torque at the socket.

In still another presently preferred embodiment, at least one elongated storage tunnel open at one end is defined at least partially along the length of the elongated case member and a detachable tool is configured to be slidably received within the storage tunnel. In this assembly, two examples of such detachable tools are a pair of tweezers and a flat head screw driver having a blade of a size to fit the head of an adjustment screw on the carburetor of the power chain saw. Additionally, at least one elongated retaining tunnel open at one end is defined at least partially along the length of the elongated case member and is configured to slidably and nonrotatably receive the handle of a detachable tool such as a file for sharpening the sawblade teeth of the chain. A retaining member is disposed at one end of the case member, wherein the slide member defines an elongated guide groove disposed to engage the retaining member at the end of the slide member opposite from the attachment of the at least one interleaved member such that the retaining member comprises a pivotal joinder between the slide member and the case member when the slide member is maximally extracted from the case member.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. Thus, it is intended that the present invention cover such modifications and variations as come within the scope of the appended claims and their equivalents. The same numerals are assigned to the same components throughout the drawings and description.

Figure 1:
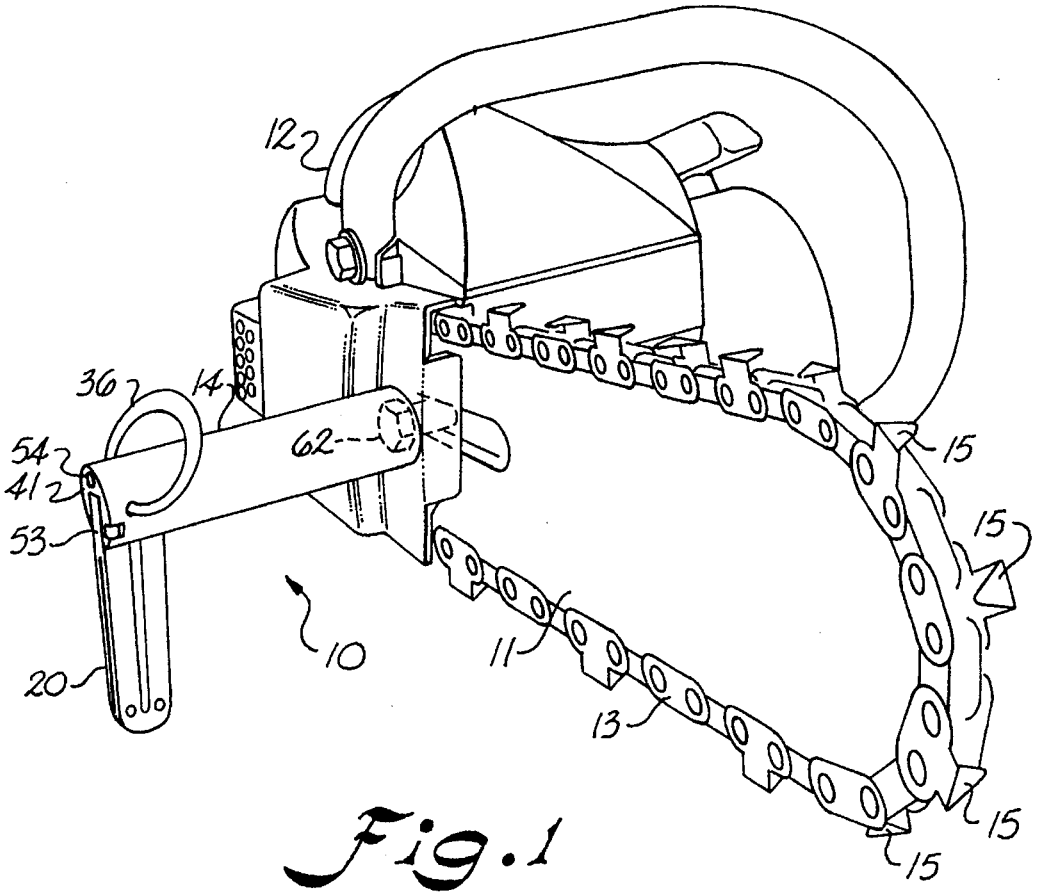
FIG. 1 is an elevated perspective view of a preferred embodiment of the apparatus of the present invention shown in relation to a power chain saw.

A presently preferred embodiment of the power chain saw utility tool of the present invention is shown in FIG. 1 and is represented generally by the designating numeral 10. Power chain saw utility tool 10 is shown in an operative relation to a chain saw 12 having an adjustable chain bar 11 on which chain 13 rides bearing a plurality of sawblades 15.

The utility tool of the present invention includes two elongated members that are configured to be connected telescopically to each other so that one elongated member is slidably received into an elongated compartment formed in the interior of the other elongated member. One of the elongated members houses a tool in one closed end thereof and functions as a storage case for the other elongated member and for various tools. The other elongated member functions as a platform for deploying various tools and for applying leverage to the tool housed in the the storage case member.

Figure 2:
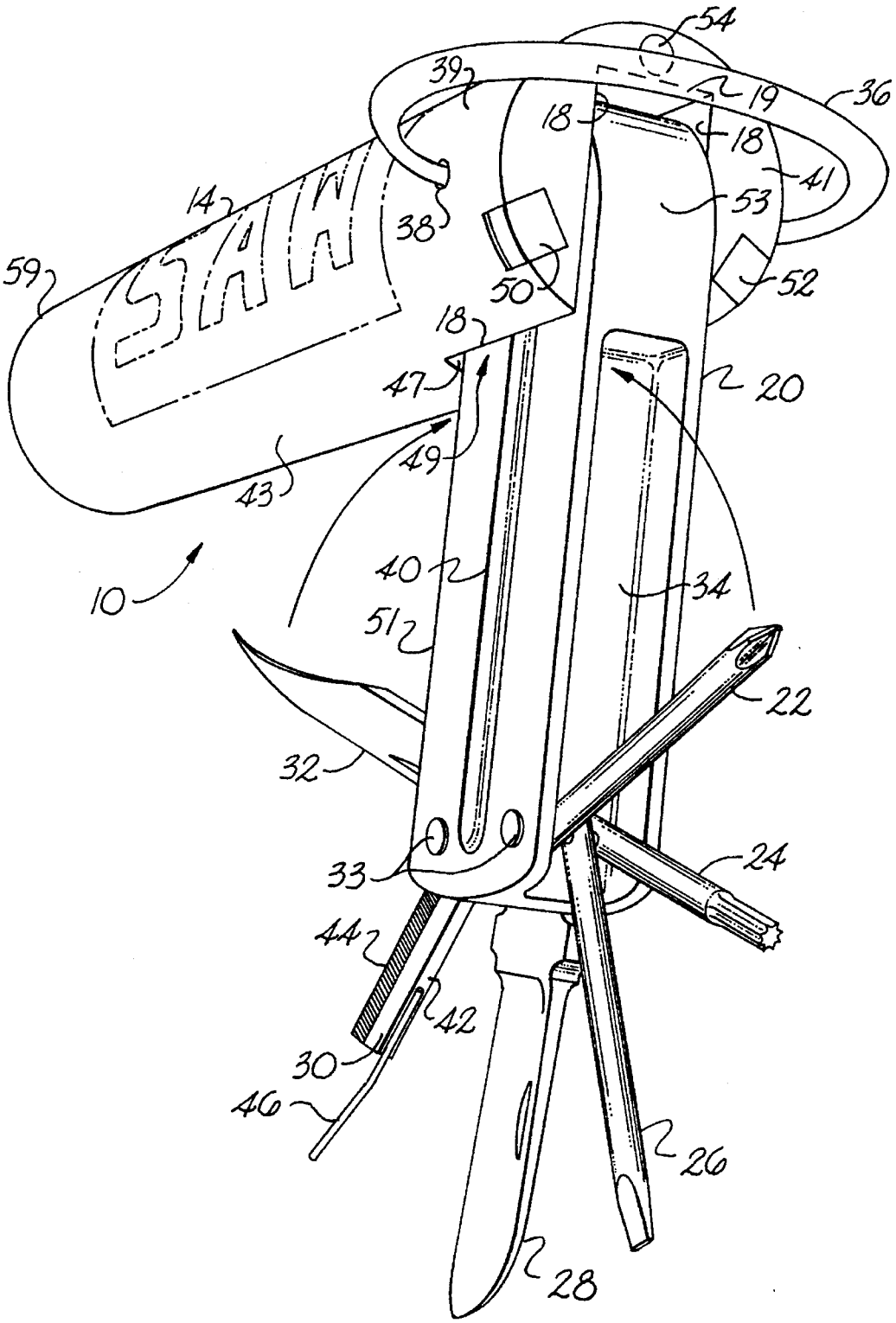
FIG. 2 is an elevated perspective view of the apparatus of the invention shown in FIG. 1 with certain tools partially deployed.

Referring now to FIG. 2, an elevated perspective view of the power chain saw utility tool is shown with certain tools partially deployed. Specifically, power chain saw utility tool 10 is comprised of an elongated cylindrical case member 14 and an elongated slide member 20.

Figure 3:
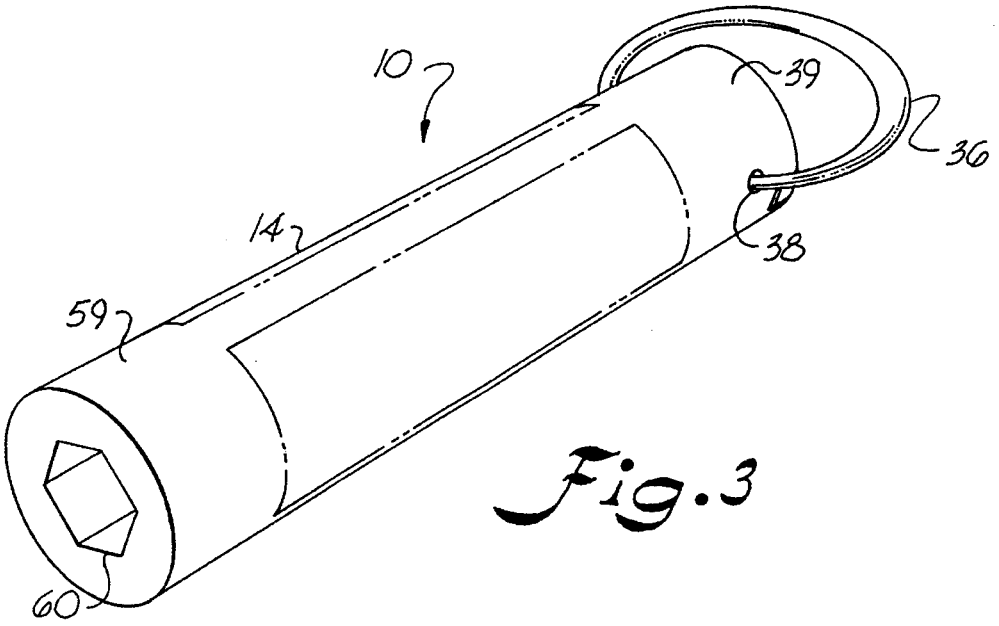
FIG. 3 is a side perspective view of the apparatus of the present invention shown in FIGS. 1 and 2.

As shown in FIGS. 2 and 3 for example, case member 14 has a closed end 59 disposed opposite a forward open end 39. As shown in FIG. 3, a socket 60 is defined in closed end 59 of case member 14. As shown in FIG. 1 for example, socket 60 is configured with a shape to receive a fastener, such as a nut or the head 62 of a bolt that secures the housing assembly of the chain bar of the power chain saw 12. It is intended that the size of socket 60 may vary according to the brand of power chain saw 12 and in this exemplary embodiment is a three-quarters inch size. It is furthermore intended that socket 60 may be used for various purposes, for example, to remove the spark plug from power chain saw 12. However, as shown in FIG. 1, socket 60 primarily is intended to be configured to remove the nut or head 62 of a threaded bolt used to secure the housing assembly of the chain bar 11 of the power chain saw 10.

Figure 4:
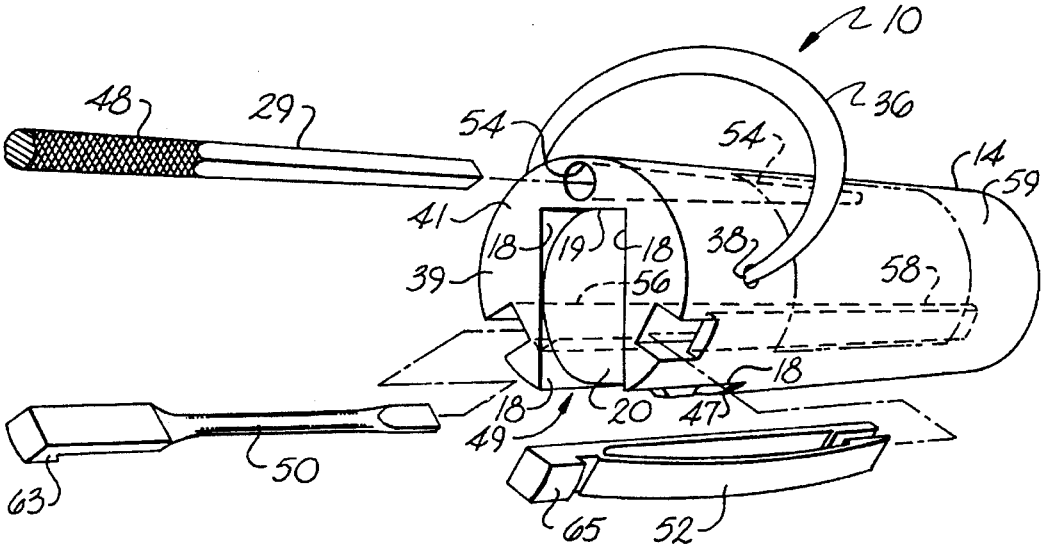
FIG. 4 is an end perspective assembly view of the apparatus of FIGS. 1 and 2 with certain tools withdrawn.
Figure 5A:
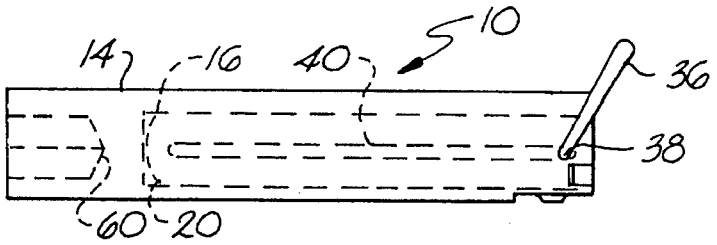
FIG. 5A is a side plan view of the embodiment of FIGS. 1 and 2 with certain internal features shown in phantom by the dashed lines.

As embodied herein and shown for example in FIG. 2, case member 14 is hollowed to form an elongated interior compartment (denoted in FIG. 5A by dashed line 16) having a transverse cross-sectional shape that can be circular or non-circular. As shown in FIGS. 2 and 5A for example, elongated interior compartment 16 is defined by a pair of opposed sidewalls 18 and a back wall 19 which connects sidewalls 18. Preferably, the three walls 18, 19 cooperate to provide interior compartment 16 with a non-circular transverse cross-sectional shape. As shown in FIGS. 2 and 4 for example, case member 14 has a forward face 41 disposed on forward end 39 and configured with a slotted end opening defined by three cooperating walls 18, 19.

As shown in FIGS. 2 and 4 for example, slide member 20 is configured with a transverse exterior cross-sectional shape such that slide member 20 may be selectively telescopically received within elongated interior compartment 16 via the slotted end opening formed by cooperating walls 18, 19. The operator selects whether slide member 20 is deployed so as to be received within compartment 16 or extracted from within compartment 16.

As shown in FIG. 2, slide member 20 includes a plurality of interleaved tools 22, 24, 26, 28, 30, and 32 pivotally attached about pins 33 at one end of slide member 20 and retractable into side recesses 34 on opposite sides of slide member 20 (one of said recesses 34 not shown). Thus, when tools 22, 24, 26, 28, 30, and 32 are retracted into their respective side recesses 34, slide member 20 is telescopically retractable into elongated interior compartment 16 as shown in FIG. 5A.

When maximally extracted, however, slide member 20 is pivotally joined to case member 14 by a retaining and engagement member such as a loop 36 shown in FIGS. 1–5C. The interior ends of retaining and engagement member 36 extend through the outer wall of case member 14 via openings 38 through a forward open end 39 of case member 14. Retaining and engagement member 36 engages elongated guide grooves 40 (as is more clearly illustrated in FIG. 5A) defined on opposite sides of slide member 20, one of said elongated guide grooves 40 being illustrated in FIG. 2. Retaining and engagement member 36, therefore, creates a pivotal joinder between case member 14 and slide member 20 when slide member 20 is extracted such that the closed ends of elongated guide grooves 40 engage the interior ends of retaining and engagement member 36.

Figure 5B:
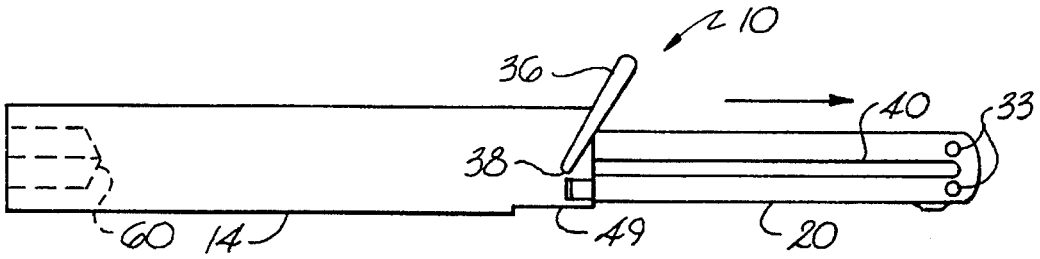
FIG. 5B is a side plan view of the embodiment of FIGS. 1 and 2 with certain internal features shown in a deployed configuration.

For example, slide member 20 is shown deployed in a fully retracted position in FIG. 5A and in a maximally extracted position in FIG. 5B. In this maximally extracted position, slide member 20 is pivotally joined to case member 14 by retaining and engagement member 36 at openings 38. Slide member 14 may only pivot, however, in a forward position (shown in FIG. 5C) due to the locking configuration of the opening defined by opposed sidewalls 18 and adjoining back wall 19 as shown in FIGS. 2 and 4. That is, when slide member 20 is in the fully extracted position, its rear side 53 (FIG. 2) is flush with and restrained by back wall 19.

Figure 5C:
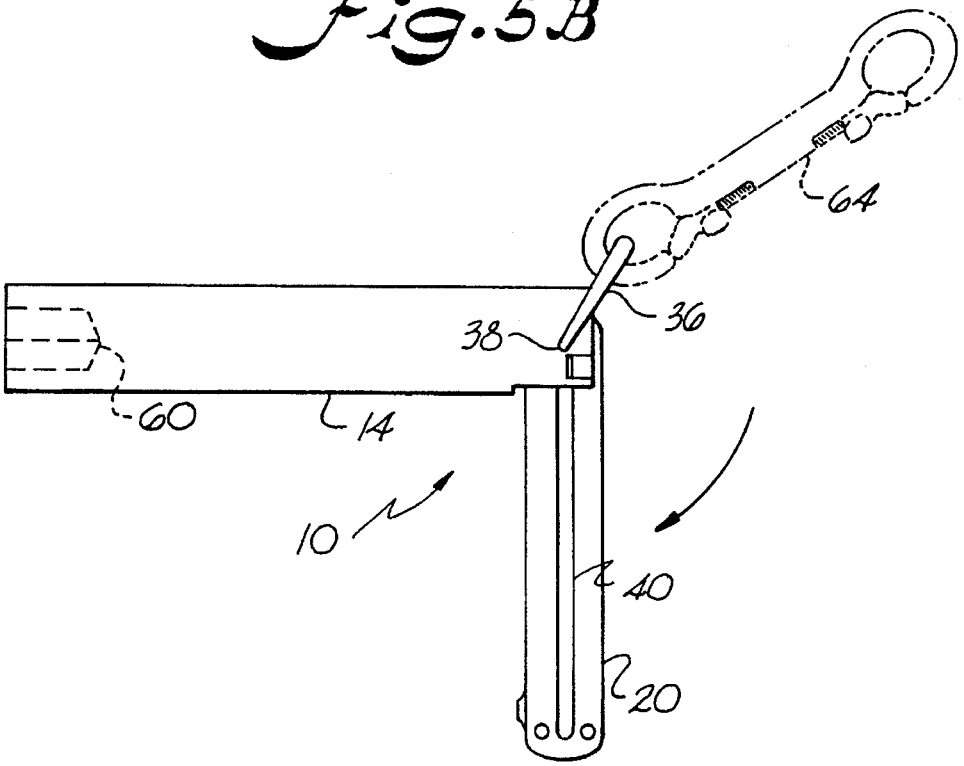
FIG. 5C is a side plan view of the embodiment of FIGS. 1 and 2 with certain internal features shown in a second deployed configuration.

Furthermore, as shown in FIGS. 2 and 5C for example, slide member 20 is restrained from forwardly pivoting beyond a position perpendicular to case member 14 due to the locking nature of a side opening (indicated generally in FIGS. 2 and 4 by the designating numeral 49) defined through an exterior surface 43 of case member 14 at the mouth of elongated interior compartment 16. As shown in FIG. 2 for example, such side opening 49 forms a slotted locking opening 49 that is defined by a pair of opposed lateral walls 18 and a forward wall 47. Side opening 49 is configured in a rectangular shape so as to receive slide member 20 with its rectangular transverse exterior shape such that, in said perpendicular position, forward side 51 of slide member 20 is flush with and restrained by forward wall 47, and rear side 53 of slide member 20 is coplanar with a forward end face 41 of case member 14.

In this embodiment, as shown in FIG. 1 for example, the pivotal joinder of case member 14 to slide member 20 allows a perpendicular relationship between case member 14 and slide member 20. The operator then may grip slide member 20 of power chain saw utility tool 10 and apply a force to slide member 20 perpendicularly to the plane of slide member 20 and case member 14, thereby applying a torque through socket 60 to head 62 of a threaded bolt used to secure the chain bar housing of the chain saw 12 depicted in FIG. 1. Thus, when slide member 20 is deployed perpendicularly with respect to case member 14, slide member 14 may be used by the operator as a lever with which to apply a torque through socket 60.

However, when slide member 20 is extracted in a coaxial position with respect to case member 14 as shown in FIG. 5B, an operator may grip device 10 so as to cover the locking opening 49 defined by walls 18 and 47 (not visible in FIG. 5B) and thus utilize case member 14 as a horizontal handle while deploying an interleaved tool. Thus, a power chain saw operator may selectively extract slide member 20 to deploy a needed tool or retract slide member 20 into case member 14 for efficient storage.

In this presently preferred embodiment, slide member 20 pivotally deploys various tools for making adjustments and repairs to power chain saws. For example, the free end of a driver 24 can be configured as a torques driver, or so-called "star" wrench, for use with power chain saw 12. Other pivotally deployable tools may include a phillips head screwdriver 22 and an implement such as a flat head screwdriver 26, which can be configured to activate the adjustment mechanism that regulates the tension applied to chain 13 by chain bar 11. For example, flat head screwdriver 26 may be configured with a blade sized to fit the slot in the head of the screw (not shown) conventionally used in power chain saws to adjust the position of chain bar 11 and thereby regulate the tension applied to chain 13 by chain bar 11. A conventional knife blade 28 can form one of the deployable tools. A wire tool 30 can be provided as another of the pivotally deployable tools and can include a file 44 that can be used by the operator to clean the spark plug point. Moreover, as shown in FIG. 2 for example, wire tool 30 desirably is provided with a blunt edge 42 disposed opposite to file 44 and configured with a transverse thickness that is approximately equal to the gap of the spark plug used in the power chain saw. An operator can insert edge 42 of wire tool 30 into the gap of the power saw's spark plug and set the spark plug gap to the proper distance. Furthermore, wire tool can include a wire device 46, which the operator may use to clean the oil hole in the chain bar of power chain saw 12. Wire device 46 also can be used for cleaning hard-to-reach crevices of a fouled spark plug of the power chain saw. Similarly, a utility cleaning tool 32 can be provided with a scooped end suited for cleaning the groove (not shown) conventionally provided in chain bar 11 of a typical power chain saw 12.

Furthermore, case member 14 is configured to store various additional detachable tools as might be useful to the operator of power chain saw 12. In this embodiment, for example, and referring now to FIG. 4, a screwdriver 50 and a pair of tweezers 52 are stored in respective elongated closed storage tunnels 56, 58. Each storage tunnel 56, 58 is defined longitudinally along part of the length of case member 14, and the operator can pull on the respective head 63, 65 of screwdriver 50 and tweezers 52 to facilitate manual extraction of such detachable tools from their respective storage tunnels 56, 58. Desirably, screwdriver 50 is configured so that its blade fits into the slot of a screw used to adjust the carburetor of the power chain saw. The operator then can adjust the carburetor by inserting the blade of screwdriver 50 into the slot in the head of the carburetor adjustment screw and turning such screw.

Additionally, as shown for example in FIG. 4, the utility tool of the present invention desirably can include a retaining tunnel 54 that is defined longitudinally along part of the length of case member 14. Retaining tunnel 54 can be tapered and configured so that a handle 29 of a file 48 (partially shown in FIG. 4) can be slidably and nonrotatably received within retaining tunnel 54. As shown in FIG. 4, retaining tunnel has a circular transverse cross-sectional shape, and handle 29 of file 48 has a square transverse cross-sectional shape. The operator can use file 48 to sharpen the sawblade teeth of chain 13 and then remove its handle 29 from retaining tunnel 54 for storage of file 48 elsewhere.

The above described tools, both detachable and pivotally deployable, and socket 60 do not constitute a limitation on the present invention, but serve merely to illustrate one embodiment thereof. It will be understood by those of ordinary skill in the art, however, that various tools may be desirable for use with a number of different brands of power chain saws. Thus, it is understood to be within the scope and the spirit of the present invention to include on slide member 20 and stored in case member 14 various types of detachable and pivotally deployable tools applicable to maintaining and repairing more than one brand of power chain saws. However, it is desirable that socket 60, the deployable tools and the detachable tools of the power chain saw utility tool of the present invention are sized and configured to service a particular brand of chain saw, which brand can be emblazoned on case member 14 where the word "saw" appears in dashed lines in FIG. 2 for example or in another location of utility tool 10.

Additionally, in this presently preferred embodiment, case member 14 comprises a cylindrical member having a smooth external surface 43 as seen in FIG. 2. Such a configuration is desirable both for its compact nature and for the ease with which an operator may handle the case member when utilizing the interleaved tools. Also, this configuration is conducive to a manufacturer's labeling, as is seen in FIG. 2.

From the above discussion, it will apparent to those of ordinary skill in the art that power chain saw utility tool 10 provides easy and efficient access to tools required for maintaining and repairing power chain saws. The compact nature of the apparatus and assembly of the present invention allow an operator, for example a tree surgeon, to carry power chain saw utility tool 10 to remote locations, for example, into a tree, where such tools may be otherwise inaccessible. Furthermore, in such a remote location, an operator may have only one free hand with which to work, thereby making retrieval of similar tools from a belt or a pocket difficult. Therefore, and referring to FIG. 5C, in this presently preferred embodiment retaining and engagement member 36 is configured in a loop fashion so that it may be engaged to a detachable fastening device 64, which in turn may be secured to an article worn by the operator of the power chain saw. Detachable fastening device 64 may be worn, for example, on a chain or retractable cord attached to the operator's belt so that the operator need only reach to his side to retrieve power chain saw utility tool 10.

While particular embodiments of the invention have been described and shown, it will be understood by those of ordinary skill in this art that the present invention is not limited thereto since many modifications may be made. For example, there may be many equivalent configurations by which the case member and the slide member may be assembled such that the power chain saw tools are deployable and that torque may be provided to the socket. Therefore, it is contemplated by the present application to cover any and all such embodiments that may fall within the scope of the invention and the appended claims.

What is claimed is:

1. An apparatus for effecting mechanical repairs and/or adjustments to a power chain saw having an oil hole for receiving oil, a spark plug, a chain bearing sawblades, a chain bar disposed to tension the chain and having a groove, a chain bar housing secured by a fastener, and an adjustment mechanism for regulating the tension applied by the chain bar to the chain of the power chain saw, the apparatus comprising:

a first elongated member including a plurality of interleaved members wherein at least one interleaved member is pivotally attached at one end thereof to said elongated member and is configured in the form of a tool adaptable for making repairs and/or adjustments to the power chain saw, said tool being selectively pivotable about said one end for selectively deploying said tool in an operational mode; and a second elongated member having a closed end disposed on one side thereof, said closed end defining a socket configured with a shape to receive the fastener on the power chain saw, said second elongated member being operatively connected to said first elongated member such that said first elongated member may be operatively disposed at an angle less than 180 degrees with respect to said second elongated member, whereby a force perpendicularly applied to said first elongated member creates a torque at said socket.

2. The apparatus as in claim 1, wherein said at least one interleaved member is an implement configured to activate adjustment mechanism for regulating the tension applied by the chain bar to the chain of the power chain saw.

3. The apparatus as in claim 1, wherein said at least one interleaved member is a torques driver.

4. The apparatus as in claim 1, wherein said at least one interleaved member is a knife blade.

5. The apparatus as in claim 1, wherein said at least one interleaved member is a wire tool for cleaning oil from the oil hole of the power chain saw.

6. The apparatus as in claim 1, wherein said at least one interleaved member is a file for cleaning the spark plug point of the spark plug employed in the power chain saw.

7. The apparatus as in claim 1, wherein said at least one interleaved member is a wire tool having a blunt edge along an opposite lateral edge, wherein at least of portion of the transverse width of said blunt edge is of a size approximately equal to the spark plug gap of the spark plug employed in the power chain saw.

8. The apparatus as in claim 1, wherein said at least one interleaved member is a utility cleaning tool having a scooped end of a size appropriate for cleaning the chain bar groove of the power chain saw.

9. An apparatus for effecting mechanical repairs and/or adjustments to a power chain saw having a chain bearing sawblade teeth, an oil hole for receiving oil, a carburetor with a screw head for adjusting the carburetor, a spark plug having a gap and a point, a chain bar having a groove, a chain bar housing secured by a fastener, an adjustment mechanism for regulating the tension applied by the chain bar to the chain of the power chain saw, the apparatus comprising:

an elongated case member having an elongated interior compartment defined within said case member; and a slide member, said slide member including a plurality of interleaved members wherein at least one interleaved member is pivotally attached at one end thereof to said slide member and is configured in the form of a tool adaptable for making minor repairs and/or adjustments to the power chain saw, said tool being selectively pivotable about said one end for selectively deploying said tool in an operational mode, said slide member having a transverse exterior cross-sectional shape configured such that said slide member may be selectively telescopically received within said elongated interior compartment defined within said case member, and said slide member being configured to cooperate with said case member such that said slide member may, when maximally extracted from said case member, be selectively disposed at an angle less than 180 degrees with respect to said case member.

10. An apparatus as in claim 9, further comprising:

a plurality of storage tunnels open at one end and defined at least partially along the length of said elongated case member;

a plurality of detachable tools, each said detachable tool being configured to be slidably received within one of said storage tunnels, one of said detachable tools comprising a flat head screw driver having a blade of a size to fit a screw head on the power chain saw, another of said detachable tools comprising a pair of tweezers; and wherein each of said plurality of interleaved members is pivotally attached at said one end of said slide member, one of said interleaved members comprises a flat head screwdriver having a blade of a size appropriate to adjust the adjustment mechanism for regulating the tension applied by the chain bar to the chain of the power chain saw, another of said interleaved members comprises a torques driver, yet another of said interleaved members comprises a knife blade, still another of said interleaved members comprises a wire tool for cleaning oil from the oil hole of the power chain saw and having a blunt edge wherein at least a portion of the transverse width of said blunt edge is of a size approximately equal to the spark plug gap of the spark plug employed in the power chain saw, a file for cleaning the spark plug point of the spark plug employed in the power chain saw, and an elongated cleaning tool having a scooped end configured for cleaning the chain bar groove of the power chain saw.

11. An apparatus for effecting mechanical repairs and/or adjustments to a power chain saw having a chain bearing sawblade teeth, an oil hole for receiving oil, a carburetor with a screw head for adjusting the carburetor, a spark plug having a gap and a point, a chain bar having a groove, a chain bar housing secured by a fastener, an adjustment mechanism for regulating the tension applied by the chain bar to the chain of the power chain saw, the apparatus comprising:

an elongated case member having an elongated interior compartment defined within said case member; and a slide member, said slide member including a plurality of interleaved members wherein at least one interleaved member is pivotally attached at one end thereof to said slide member and is configured in the form of a tool adaptable for making minor repairs and/or adjustments to the power chain saw, said tool being selectively pivotable about said one end for selectively deploying said tool in an operational mode, said slide member having a transverse exterior cross-sectional shape configured such that said slide member may be selectively telescopically received within said elongated interior compartment defined within said case member, wherein said case member having a first end and a second end disposed opposite to said first end, said second end of said case member defining an end face, said first end of said case member defining a socket having a shape configured to receive the fastener that secures the chain bar housing of the power chain saw.

12. An apparatus as in claim 11, further comprising:

a retaining and engaging member configured to engage said slide member when said slide member is maximally extracted from said case member so that said slide member may be selectively disposed at an angle less than 180 degrees with respect to said case member, whereby a force perpendicularly applied to said slide member creates a torque at said socket.

13. An apparatus as in claim 11, further comprising:

an elongated storage tunnel open at one end and defined at least partially along the length of said elongated case member; and a detachable tool configured to be slidably received within said storage tunnel.

14. An apparatus as in claim 13, wherein said detachable tool is a flat head screw driver having a blade of a size to fit the screw head for the carburetor on the power chain saw.

15. An apparatus as in claim 13, wherein said detachable tool is a pair of tweezers.

16. An apparatus as in claim 11, wherein said case member defines a retaining tunnel longitudinally within and along part of the length of said case member and configured so that a handle of a file can be slidably and nonrotatably received within said retaining tunnel to enable the operator to sharpen the sawblade teeth of the power chain saw.

17. An apparatus as in claim 12, wherein said retaining and engagement member is configured to be engaged to a detachable fastening device for detachably securing said case member to an article worn by the operator of the power chain saw.

18. An apparatus as in claim 12, further comprising a first elongated guide groove defined along one side of said slide member and a second guide groove defined along an opposite side of said slide member, each said guide groove defining a first closed end and a second closed end disposed opposite said first closed end; and wherein said retaining and engaging member is configured to engage, when said slide member is maximally extracted from said case member, one of said first and second closed ends of each of said two elongated guide grooves defined along opposite sides of said slide member such that said retaining and engaging member provides a pivotal joinder between said slide member and said case member.

19. An apparatus as in claim 10, further comprising:

three walls cooperating to define a first slot in said end face of said second end of said case member, said first slot defining an end opening to said interior compartment, said first slot being configured to permit passage of said slide member, two of said three walls being disposed in opposition and defining the width of said first slot, the third of said three walls defining a back wall disposed transversely to said two walls defining said width, said back wall being configured to be flush with and to restrain said slide member so that said slide member, when maximally extracted from said case member, may pivot only in a forward direction; and a fourth wall disposed to cooperate with said two opposed walls to define a second slot contiguous with said first slot and extending through said exterior surface of said case member, said second slot defining a side opening to said interior compartment and having a width equal to said width of said first slot, said fourth wall being disposed transversely to said opposed walls and to said third wall, said fourth wall being configured to restrain said slide member to a maximum pivotal position perpendicular to said case member so that said slide member may be utilized as a lever by which to apply a torque to said socket.

* * * * *